US009123291B2

(12) United States Patent
Duan et al.

(10) Patent No.: US 9,123,291 B2
(45) Date of Patent: Sep. 1, 2015

(54) PIXEL CIRCUIT, DRIVING METHOD THEREOF AND PIXEL ARRAY STRUCTURE

(71) Applicant: BOE TECHNOLOGY GROUP CO., LTD., Beijing (CN)

(72) Inventors: Liye Duan, Beijing (CN); Lirong Wang, Beijing (CN); Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 14/355,470

(22) PCT Filed: Dec. 16, 2013

(86) PCT No.: PCT/CN2013/089522

§ 371 (c)(1),
(2) Date: Apr. 30, 2014

(87) PCT Pub. No.: WO2014/194638

PCT Pub. Date: Dec. 11, 2014

(65) Prior Publication Data

US 2014/0362130 A1 Dec. 11, 2014

(30) Foreign Application Priority Data

Jun. 6, 2013 (CN) ..... 2013 1 0224463

(51) Int. Cl.
*G09G 3/30* (2006.01)
*G09G 3/32* (2006.01)

(52) U.S. Cl.
CPC ..... *G09G 3/3225* (2013.01)

(58) Field of Classification Search
CPC ..... G09G 3/3225
USPC ..... 345/76
See application file for complete search history.

(56) References Cited

U.S. PATENT DOCUMENTS 6,661,180 B2 * 12/2003 Koyama ..... 315/169.3
2010/0006866 A1 1/2010 Koyama

FOREIGN PATENT DOCUMENTS

CN 1612194 A 5/2005
CN 1702727 A 11/2005

(Continued)

OTHER PUBLICATIONS

Written Opinion of the International Searching Authority dated Mar. 16, 2014; PCT/CN2013/089522.
First Chinese Office Action dated Nov. 3, 2014; Appln. No. 201310224463.1.

(Continued)

*Primary Examiner* — Jonathan Boyd
(74) *Attorney, Agent, or Firm* — Ladas & Parry LLP

(57) ABSTRACT

Disclosed are a pixel circuit, a driving method thereof and a pixel array structure. The pixel circuit comprises a load controlling module(101), a load module(102), a gray scale selection module(103), a driving module(104) and a light-emitting device(105). The load controlling module(101) outputs an analog data signal through a first node and a second node under the control of a first scan signal (scan1). The load module(102) is connected with a first power supply terminal (VSS), the driving module(104), the first node(A1) and the second node(A2), respectively, and stores the analog data signal in the load module(102) and provides the driving module(104) with the analog data signal under the control of signals from the first node and the second node. The gray scale selection module(103) transmits a digital data signal to a third node(A3) located in the gray scale selection module (103) under the control of a second scan signal (scan2). The driving module(104) drives the light-emitting device(105) under the control of the signals from the second node and the third node. A first terminal of the light-emitting device(105) is connected with a second power supply terminal(VDD), a second terminal thereof is connected with the driving module (104). The pixel circuit is capable of reducing a charging time of an OLED pixel circuit.

19 Claims, 6 Drawing Sheets

(56) References Cited

FOREIGN PATENT DOCUMENTS

| | | | |
|---|---|---|---|
| CN | 103310730 | A | 9/2013 |
| CN | 203300188 | U | 11/2013 |
| KR | 20090057709 | A | 6/2009 |

OTHER PUBLICATIONS

International Search Report mailed Mar. 27, 2014; PCT/CN2013/089522.

* cited by examiner

PIXEL CIRCUIT, DRIVING METHOD THEREOF AND PIXEL ARRAY STRUCTURE

TECHNICAL FIELD

The present disclosure relates to a field of display technique, and particularly, to a pixel circuit, a driving method thereof and a pixel array structure.

BACKGROUND

The luminance of an Organic electroluminescent display OLED is directly proportional to a driving current flowing therethrough, and therefore a pixel circuit must provide the OLED with a sustained and stable driving current during a whole frame period. A driving manner of the existing OLED pixel circuit may be divided into a current driving mode and a voltage driving mode, as illustrated in FIG. 1 and FIG. 2, respectively.

In a voltage-mode driving circuit, a current $I_{oled}$ flowing through a light-emitting device is:

$$I_{OLED} = \frac{1}{2}\mu_n \cdot \mathrm{Cox} \cdot \frac{W}{L} \cdot (Vdata - Voled - Vth)^2.$$

Wherein $\mu_n$ is a mobility of carriers, $C_{OX}$ is a capacitance in an oxide layer at a gate, W/L is a width-length ratio of the transistor, $V_{data}$ is a data voltage, $V_{oled}$ is an operational voltage of the OLED and is shared by all of sub-pixel units, Vth is a threshold voltage of the transistor, which is a positive value for an enhanced Thin Film Transistor TFT and is a negative value for a depletion TFT. It can be seen from the above equation that the currents would be different if the threshold voltages Vth are different among the different pixel units. If the Vth in a pixel drifts as time elapses, the current would also vary with time and an image sticking may occur. Also, the variations in the current may also be resulted from the differences in the operational voltages of the OLEDs due to the non-uniformity in the OLED devices.

As compared with the voltage-mode driving mode, the current-mode driving mode has advantages as follows. The current $I_{oled}=I_{data}$, and if the threshold voltage of the pixel drifts as the time elapses, the current-mode driving circuit has a capability of self-adjusting the current level of the current so that the current is independent of the Vth of the TFT device, and thus a display which is uniform in space and stable in time can be achieved. The current-mode driving circuit is generally applied to a panel with a small size, however, because of its long driving time. FIG. 3 is an exemplary view illustrating a structure of a current-mode driving circuit for a pixel driving circuit, and FIG. 4 is a timing diagram of the circuit structure shown in FIG. 3. It can be seen from these two figures that the operation of the circuit is divided into two phases of a per-charging phase t1 and a light-emitting phase s2. During the t1 phase, an ARVDD is at a low level, a SCAN is at a high level, a transistor M4 is turned off, and a Cs is charged; and during the t2 phase, the ARVDD is at the high level, the SCAN is at the low level, transistors M1 and M2 are turned off, and an OLED emits light. Such a current-mode driving pixel circuit has a great defect in that a charging time of its capacitor is too long so that the display is affected, which may in turn restrain a large scale application of the current-mode driving circuit.

SUMMARY

Embodiments of the present disclosure provide a pixel circuit, a driving method thereof and a pixel array structure, which are capable of reducing a charging time of an OLED pixel circuit.

The embodiments of the present disclosure provide a pixel circuit comprising a load controlling module, a load module, a gray scale selection module, a driving module and a light-emitting device, wherein:

the load controlling module is connected with a first scan signal line and a data signal line, and is used for outputting an analog data signal through a first node and a second node under the control of a first scan signal;

the load module is connected with a first power supply terminal, the driving module, the first node and the second node, respectively, and is used for storing the analog data signal under an action of a first power supply and providing the driving module with the analog data signal, under the control of signals from the first node and the second node;

the gray scale selection module is connected with a second scan signal line and the data signal line, and is used for transmitting a digital data signal to a third node located in the gray scale selection module under the control of a second scan signal;

the driving module is used for driving the light-emitting device under the control of the signals from the second node and the third node; and a first terminal of the light-emitting device is connected with a second power supply terminal, a second terminal thereof is connected with the driving module, and the light-emitting device emits light under actions of the second power supply and the driving module.

The embodiments of the present disclosure provide a pixel array structure comprising a plurality of column drivers and a plurality of pixel circuits described above arranged in a matrix, and the column drivers are used for outputting the data signal to the pixel circuits.

The embodiments of the present disclosure provide a driving method for a pixel circuit, comprising:

during a first phase, outputting an analog data signal by a data signal line, transmitting the analog data signal to a load module and storing the analog data signal in the load module by a load controlling module, and no light being emitted from a light-emitting device;

during a second phase, outputting a digital data signal by the data signal line, transmitting the digital data signal to a third node, and no light being emitted from a light-emitting device; and during a third phase, outputting a retaining signal by the data signal line, and driving the light-emitting device to emit light by the driving module according to signals from the second node and the third node.

The embodiments of the present disclosure provide a pixel circuit, a driving method thereof and a pixel array structure. The pixel circuit according to the embodiments of the present disclosure comprises a load controlling module, a load module, a gray scale selection module, a driving module and a light-emitting device, wherein: the load controlling module is connected with a first scan signal line and a data signal line, and is used for outputting an analog data signal through a first node and a second node under the control of a first scan signal; the load module is connected with a first power supply terminal, the driving module, the first node and the second node, respectively, and is used for storing the analog data signal under an action of a first power supply and providing the driving module with the analog data signal, under the control of signals from the first node and the second node; the gray scale selection module is connected with a second scan signal line and the data signal line, and is used for transmitting a digital data signal to a third node located in the gray scale selection module under the control of a second scan signal; the driving module is used for driving the light-emitting device under the control of the signals from the second node and the third node; a first terminal of the light-emitting device is connected with a second power supply terminal, a second terminal thereof is connected with the driving module, and the light-emitting device emits light under actions of the second power supply and the driving module. The load module stores the analog signal, the driving module selectively drives the light-emitting device under the control of the signals from the second node and the third node, and thus the charging time of the OLED pixel circuit may be decreased in the normal displaying.

DETAILED DESCRIPTION

Figure 1:
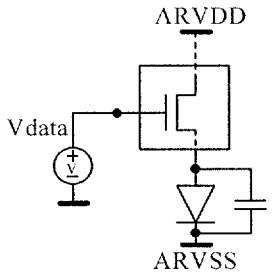
FIG. 1 is an exemplary view illustrating a basic structure of a voltage-mode driving circuit in the prior art.
Figure 2:
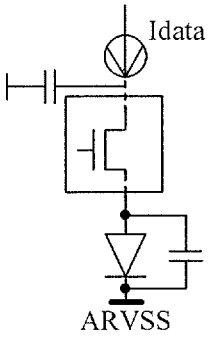
FIG. 2 is an exemplary view illustrating a basic structure of a current-mode driving circuit in the prior art.
Figure 3:
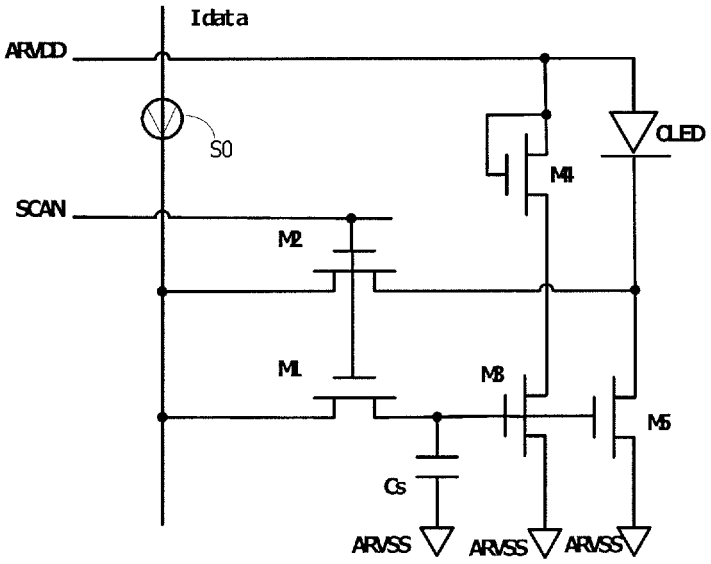
FIG. 3 is an exemplary view illustrating a structure of a current-mode driving circuit in the prior art.
Figure 4:
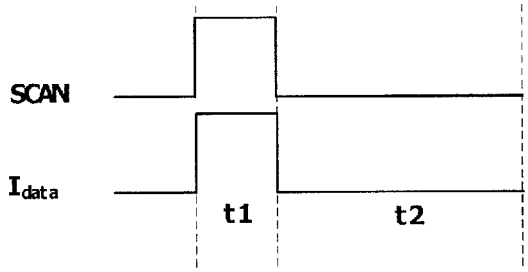
FIG. 4 is a timing diagram of the circuit structure shown in FIG. 3.

Embodiments of the present disclosure provide a pixel circuit, a driving method thereof and a pixel array structure, which are capable of decreasing a charging time of an OLED pixel circuit.

The embodiments of the present disclosure provide a pixel circuit comprising a load controlling module, a load module, a gray scale selection module, a driving module and a light-emitting device, wherein:

the load controlling module is connected with a first scan signal line and a data signal line, and outputs an analog data signal from a first node and a second node under a control of a first scan signal;

the load module is connected with a first power supply terminal, the driving module, the first node and the second node, respectively, and under controls of signals from the first node and the second node, stores the analog data signal under an action of a first power supply and provides the driving module with the analog data signal;

the gray scale selection module is connected with a second scan signal line and the data signal line, and is used for transmitting a digital data signal to a third node in the gray scale selection module under a control of a second scan signal;

the driving module is used for driving the light-emitting device under controls of the signals from the second node and the third node; and a first terminal of the light-emitting device is connected with a second power supply terminal, a second terminal thereof is connected with the driving module, and the light-emitting device emits light under actions of the second power supply and the driving module.

Optionally, the load controlling module may comprise a first thin film transistor and a second thin film transistor, wherein, a gate of the first thin film transistor is connected with the first scan signal line, a source thereof is connected with the data signal line, and a drain thereof is connected with the first node located in the load controlling module; and a gate of the second thin film transistor is connected with the first scan signal line, a source thereof is connected with the data signal line, and a drain thereof is connected with the second node located in the load controlling module.

It should be noted that the source and the drain of the thin film transistor utilized in the embodiments of the present disclosure may be exchanged since they are symmetrical. In order to distinguish the two electrodes in the thin film transistor other than the gate, one of them is referred to as the source and the other one is referred to as the drain. If the source is selected as a signal input terminal, the drain operates as a signal output terminal, and vice versa.

Optionally, the load module may comprise a first storage capacitor and a third thin film transistor, wherein, the first storage capacitor is located between the second node and the first power supply terminal; and a gate of the third thin film transistor is connected with a first terminal of the first storage capacitor, a source thereof is connected with the first node, and a drain thereof is connected with the first power supply terminal.

Optionally, the load module may further comprise a fourth thin film transistor, wherein a gate and a source of the fourth thin film transistor are connected with the second power supply terminal, and a drain thereof is connected with the first node.

Optionally, the gray scale selection module may comprise a fifth thin film transistor, wherein a gate of the fifth thin film transistor is connected with the second scan signal line, a source thereof is connected with the data signal line, and a drain thereof is connected with the third node.

Optionally, the driving module may comprise a second storage capacitor, a sixth thin film transistor, a seventh thin film transistor and an eighth thin film transistor, wherein, the second storage capacitor is located between the third node and the first power supply terminal;

a gate of the sixth thin film transistor is connected with the third node, a source thereof is connected with the second terminal of the light-emitting device, and a drain thereof is connected with a source of the seventh thin film transistor;

a gate of the seventh thin film transistor is connected with the second node, the source thereof is connected with the drain of the sixth thin film transistor, and a drain thereof is connected with the first power supply terminal; and a gate of the eighth thin film transistor is connected with the second node, a source thereof is connected with the second terminal of the light-emitting device, and a drain thereof is connected with the first power supply terminal.

Optionally, a ratio value between a weight-length ratio of the seventh thin film transistor and a weight-length ratio of the eighth thin film transistor is greater than 1. Since the sixth thin film transistor, the seventh thin film transistor and the eighth thin film transistor form a current mirror structure, a ratio value between a current flowing through the seventh thin film transistor and a current flowing through the eighth thin film transistor is directly proportional to a ratio value between the weight-length ratio of the seventh thin film transistor and the weight-length ratio of the eighth thin film transistor. At the same time, a current flowing through the third thin film transistor is a sum of the current flowing through the seventh thin film transistor and the current flowing through the eighth thin film transistor, and the current flowing through the third thin film transistor may be configured to equal to an analog data current on the data signal line by setting a proportional relationship among these three thin film transistors. For example, optionally, if the ratio value between the weight-length ratio of the seventh thin film transistor and the weight-length ratio of the eighth weight-length ratio is N, the ratio value among the weight-length ratios of the third thin film transistor, the seventh thin film transistor and the eighth thin film transistor may be set as N+1:N:1, and the ratio value between the current flowing through the seventh thin film transistor and the current flowing through the eighth thin film transistor is also N when the seventh thin film transistor and the eighth thin film transistor are turned on simultaneously.

Optionally, the light-emitting device is an Organic Light Emitting Diode OLED.

A pixel array structure according to the embodiments of the present disclosure comprises a plurality of pixel circuits arranged in a matrix and a plurality of column drivers. Each of pixel units comprises three sub-pixel units, each of the sub-pixel unit corresponds to one pixel circuit, and the pixel circuit is used to drive the OLED in the circuit to emit light so as to realize the displaying.

Optionally, the column drivers comprise a plurality of semi-digitized current sources for outputting both of the digital data signals and the analog data signals. In the prior art, the current source mostly outputs the analog data signals, which corresponds a driving current corresponding to the brightness of a picture to be displayed in each frame. Amplitudes of current values of the data signals depend on the brightness values of the corresponding pictures in the respective frames, therefore they are generally different from each other. The brightness may have a high or low gray scale. Generally, for colors with a 24 bits RGB format, a monochrome may have 8 bits, that is, 256 gray scales. Herein the gray scales 0-31 are the low gray scale, and the gray scales 32-255 are the high gray scale. For a displaying of an image with the low gray scale, a process for charging the capacitor would take a long time since the driving current is very small. A positive current digital data signal and a negative current digital data signal are supplied by the semi-digitized current source according to the embodiments of the present disclosure for an image with a high gray scale and an image with a low gray scale respectively. When the picture with the low gray scale is required to be displayed, a current higher than the low gray scale may be output as the analog data signal, but only a current corresponding to the picture with the low gray scale is controlled to flow through the light-emitting device by outputting the negative digital data signal (a negative current), so that a charging current is increased and the charging time is reduced, while an object of displaying in the low gray scale is achieved.

Alternatively, the column drivers comprise current sources for outputting the analog data signals and voltage sources for outputting the digital data signals. In this case, the image with the high gray scale and the image with the low gray scale correspond to a positive voltage digital data signal and a negative voltage digital data signal, respectively. When the picture with the low gray scale is required to be displayed, a current higher than the low gray scale may be output as the analog data signal, but only a current corresponding to the picture with the low gray scale is controlled to flow through the light-emitting device by outputting the negative digital data signal (a negative voltage), so that a charging current is increased and the charging time is reduced, while an object of displaying in the low gray scale is achieved.

A driving method for a pixel circuit according to the embodiments of the present disclosure comprises:

during a first phase, a data signal line outputs an analog data signal, a load controlling module transmits the analog data signal to a load module and stores the analog data signal in the load module, and a light-emitting device does not emit light;

during a second phase, the data signal line outputs a digital data signal, the digital data signal is transmitted to a third node, and the light-emitting device does not emit light; and during a third phase, the data signal line outputs a retaining signal, and the driving module drives the light-emitting device to emit light according to signals from the second node and the third node.

Optionally, when the current value of the analog data signal is equal to or above a current value corresponding to the gray scale 32 during the first phase, the corresponding digital data signal is a positive current or a positive voltage during the second phase; and when the current value of the analog data signal is below a current value corresponding to the gray scale 31 during the first phase, the corresponding digital data signal is a negative current or a negative voltage during the second phase.

The embodiments of the present disclosure will be described in detail in connection with drawings and specific embodiments. It should note that following embodiments are only used to explain the present disclosure in detail, but not to limit the present disclosure.

First Embodiment

In the present Embodiment 1, all of the thin film transistors are N-type thin film transistors TFTs which are turned on at a high level and turned off at a low level, the first power supply is a negative power supply VSS, and the second power supply is a positive power supply VDD. Optionally, the data signal line is supplied with the data signal by the semi-digitized current source. Such are similar in the following embodiments.

Figure 5:
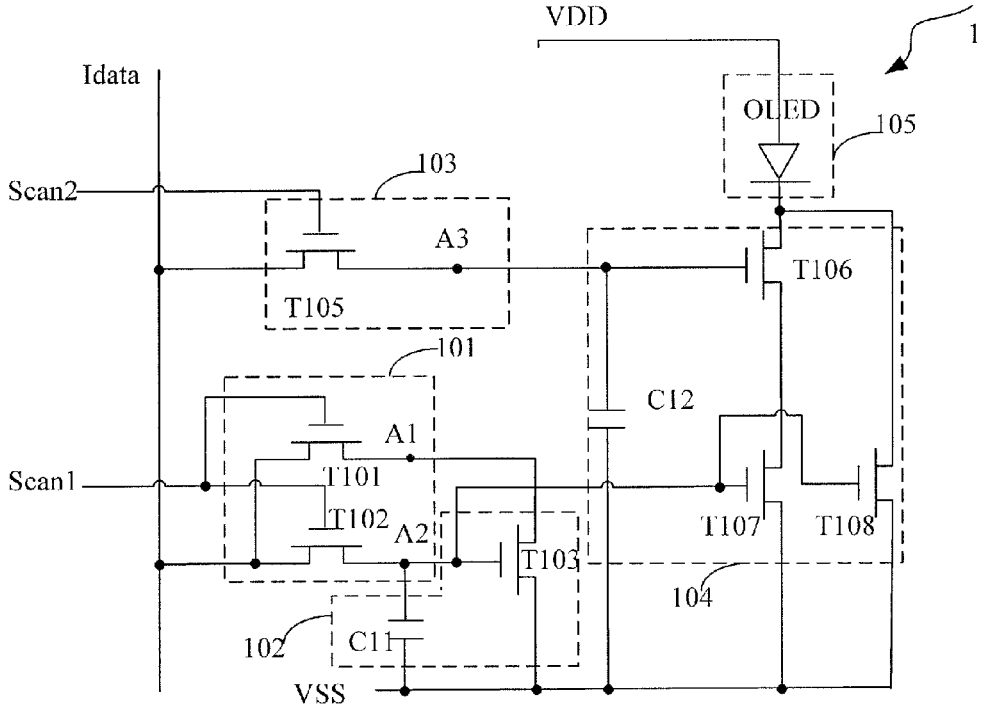
FIG. 5 is an exemplary view illustrating a structure of a pixel circuit according to a first embodiment of the present disclosure.

As illustrated in FIG. 5, the pixel circuit 1 according to the embodiment of the present disclosure comprises a load controlling module 101, a load module 102, a gray scale selection module 103, a driving module 104 and a light-emitting device 105, wherein:

the load controlling module 101 is connected with a first scan signal line Scan1 and a data signal line Idata, and is used for outputting an analog data signal through a first node A1 and a second node A2 under the control of a first scan signal;

the load module 102 is connected with a first power supply terminal VSS, the driving module 104, the first node A1 and the second node A2, respectively, and is used for storing the analog data signal under an action of a first power supply and providing the driving module 104 with the analog data signal, under the control of signals from the first node and the second node;

the gray scale selection module 103 is connected with a second scan signal line Scan2 and the data signal line Idata, and is used for transmitting a digital data signal to a third node A3 in the gray scale selection module 103 under the control of a second scan signal;

the driving module 104 is used for driving the light-emitting device 105 under the controls of the signals from the second node A2 and the third node A3; and a first terminal of the light-emitting device 105 is connected with a second power supply terminal VDD, a second terminal thereof is connected with the driving module 104, and the light-emitting device 105 emits light under actions of the second power supply and the driving module.

Optionally, the load controlling module may comprise a first thin film transistor T101 and a second thin film transistor T102, wherein, a gate of the first thin film transistor T101 is connected with the first scan signal line Scan1, a source thereof is connected with the data signal line Idata, and a drain thereof is connected with the first node A1 located in the load controlling module 101; and a gate of the second thin film transistor T102 is connected with the first scan signal line Scan1, a source thereof is connected with the data signal line $I_{data}$, and a drain thereof is connected with the second node A2 located in the load controlling module 101.

Optionally, the load module 102 may comprise a first storage capacitor C11 and a third thin film transistor T103, wherein, the first storage capacitor C11 is located between the second node A2 and the first power supply terminal VSS; and a gate of the third thin film transistor T103 is connected with a first terminal of the first storage capacitor C11, a source thereof is connected with the first node A1, and a drain thereof is connected with the first power supply terminal VSS.

Optionally, the gray scale selection module 103 may comprise a fifth thin film transistor T105, wherein a gate of the fifth thin film transistor T105 is connected with the second scan signal line Scan2, a source thereof is connected with the data signal line Idata, and a drain thereof is connected with the third node A3.

Optionally, the driving module 104 may comprise a second storage capacitor C12, a sixth thin film transistor T106, a seventh thin film transistor T107 and an eighth thin film transistor T108, wherein, the second storage capacitor C12 is located between the third node A3 and the first power supply terminal VSS;

a gate of the sixth thin film transistor T106 is connected with the third node A3, a source thereof is connected with the second terminal of the light-emitting device 105, and a drain thereof is connected with a source of the seventh thin film transistor T107;

a gate of the seventh thin film transistor T107 is connected with the second node A2, the source thereof is connected with the drain of the sixth thin film transistor T106, and a drain thereof is connected with the first power supply terminal VSS; and a gate of the eighth thin film transistor T108 is connected with the second node A2, a source thereof is connected with the second terminal of the light-emitting device 105, and a drain thereof is connected with the first power supply terminal VSS.

Optionally, the ratio values among the weight-length ratios of the third thin film transistor, the seventh thin film transistor and the eighth thin film transistor may be N+1:N:1.

Figure 6:
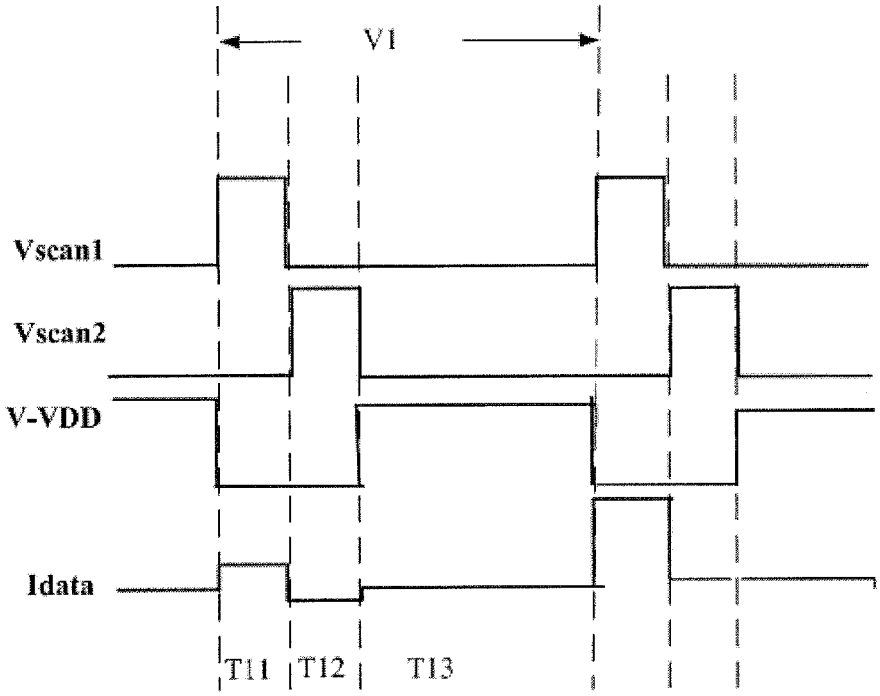
FIG. 6 is a timing diagram of the pixel circuit shown in FIG. 5.

The driving method for the pixel circuit according to the embodiments of the present disclosure will be described in detail below. Following descriptions are made in connection with the timing diagram shown in FIG. 6, wherein the timing diagram illustrates two frame periods, and the description takes the first period V1 as an example.

In a detailed implementation, the driving method for the pixel circuit according to the first Embodiment of the present disclosure comprises:

During the first phase T11: the first scan signal Scan1 is at a high level, the second scan signal scan2 is at a low level, the second power supply terminal VDD outputs a low level, the data signal line Idata outputs the analog data signal, the load controlling module 101 transmits the analog data signal to the load module 102 and stores the analog data signal in the load module 102, and the light-emitting device 105 does not emit light.

In a specific implementation, this phase T11 is a pre-charging phase. The transistors T101-T103 are turned on and remaining transistors are turned off. This process completes a charging process for the capacitor C11. The light-emitting device OLED does not emit light at this time since the VDD is at a low level. During the phase T11, the data signal is an analog data signal corresponding to a small current for the low gray scale.

A second phase T12: the first scan signal Scan1 is at the low level, the second scan signal scan2 is at the high level, the second power supply terminal VDD outputs the low level, the data signal line Idata outputs the digital data signal and the digital data signal is transmitted to the third node A3, and the light-emitting device 105 does not emit light.

In a specific implementation, this phase T12 is a discharging phase. The transistors T101, T102 are turned off and the T103, T107, T108 are turned on. Since the analog data signal for the low gray scale is input during the phase T11, the Idata is a negative digital data signal in this phase, so that the C12 is discharged and the T106 is turned off. Assuming that the weight-length ratio between the transistors T107 and T108 is N:1, only a current from the T108 flows through the OLED in this case.

During a third phase T13: the first scan signal Scan1 and the second scan signal scan2 are both at a low level, the second power supply terminal VDD outputs a high level, the data signal line Idata outputs a retaining signal, and the driving module 104 drives the light-emitting device 105 to emit light according to the signals from the second node A2 and the third node A3.

In a specific implementation, the OLED is turned on in a case that the VDD outputs the high level, and therefore a current Ioled is only equal to 1/(N+1) of the input current during the first phase. Thus the displaying in the low gray scale is realized by inputting a large current Idata to expedite the charging process of the C11 during the first phase and making the driving current Ioled small.

Of course, in a specific implementation, if the input digital data signal Idata is a signal for the high gray scale during the T12 phase, the C12 is charged and the T106 is turned on; next, during the T13 phase, the OLED is turned on since the VDD is at the high level, so that the current flowing through the OLED comprises the currents from the T107 and T108 since the T106 is turned on. In this case, it can be seen that the Ioled is a large current corresponding to the high gray scale based on a proportion between T107, T108 and T103.

Second Embodiment

Figure 7:
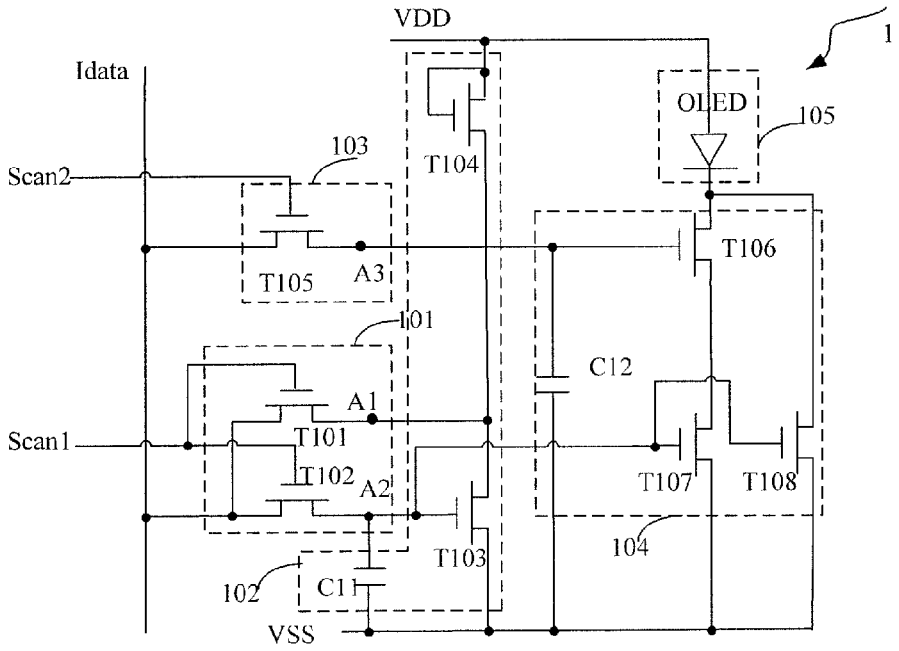
FIG. 7 is an exemplary view illustrating a structure of a pixel circuit according to a second embodiment of the present disclosure.

Unlike the first Embodiment, in the second Embodiment of the present disclosure, the load module 102 may further comprise a fourth thin film transistor T104, as illustrated in FIG. 7, wherein a gate and a source of the fourth thin film transistor T104 are connected with the second power supply terminal VDD, and a drain thereof is connected with the first node A1.

Differences between a driving method according to the second Embodiment of the present disclosure and that according to the first Embodiment are in that:

during the third phase, the T104 is turned on in order to prevent the T103 from entering a deep linear region and avoid an interference with a voltage at the gate of the T103 due to a drop of a voltage at the drain of the T103, so that the T103 may be ensured to operate in a saturation region and provide the currents to the seventh thin film transistor T107 and the eighth thin film transistor T108.

Therefore the incorporation of the fourth thin film transistor may optimize the structure of the pixel circuit.

Figure 8:
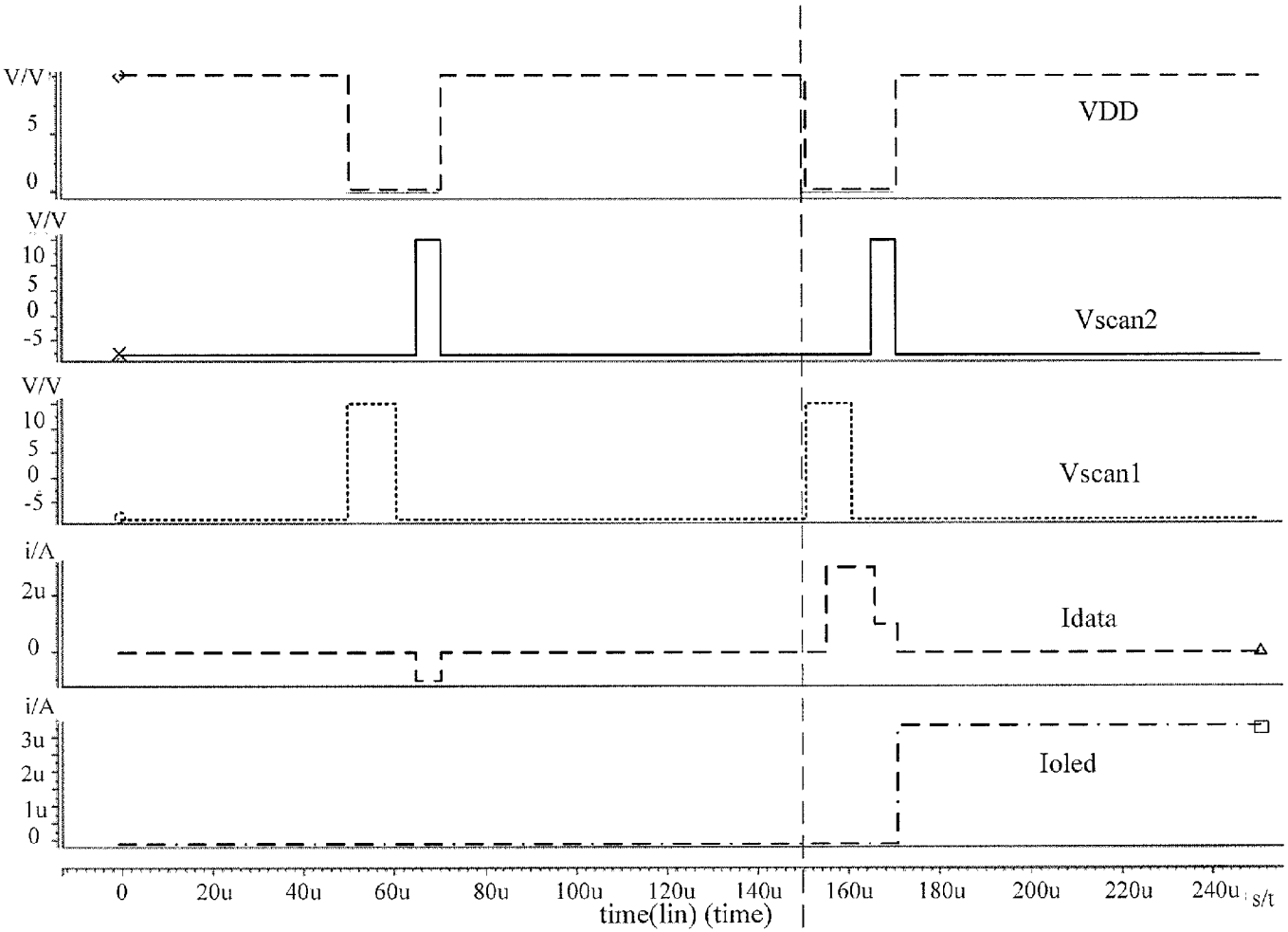
FIG. 8 is a simulated timing diagram of the pixel circuit shown in FIG. 7.

A simulation result of the second Embodiment of the present disclosure is as illustrated in FIG. 8, and following description is made by taking two frame periods as an example. During the first frame period, the current of 10 nA for the low gray scale is written into a pixel, and during the second frame period a current of 3 μA for the high gray scale is written into the pixel. Also, for the structure shown in FIG. 7, the weight-length ratio between the T107 and T108 is selected as 9:1. Therefore, a current of 100 nA, which is as 10 times as 10 nA, is input as the analog data signal during the first phase, and it can be seen from the FIG. 8 that the Ioled acquired in the first frame period is 10 nA; in the second frame period, the T107 and the T108 operate at the same time, the input analog data signal is 3 μA, and it can be seen from FIG. 8 that the current Ioled after a scan is approximately 3 μA.

Third Embodiment

Figure 9:
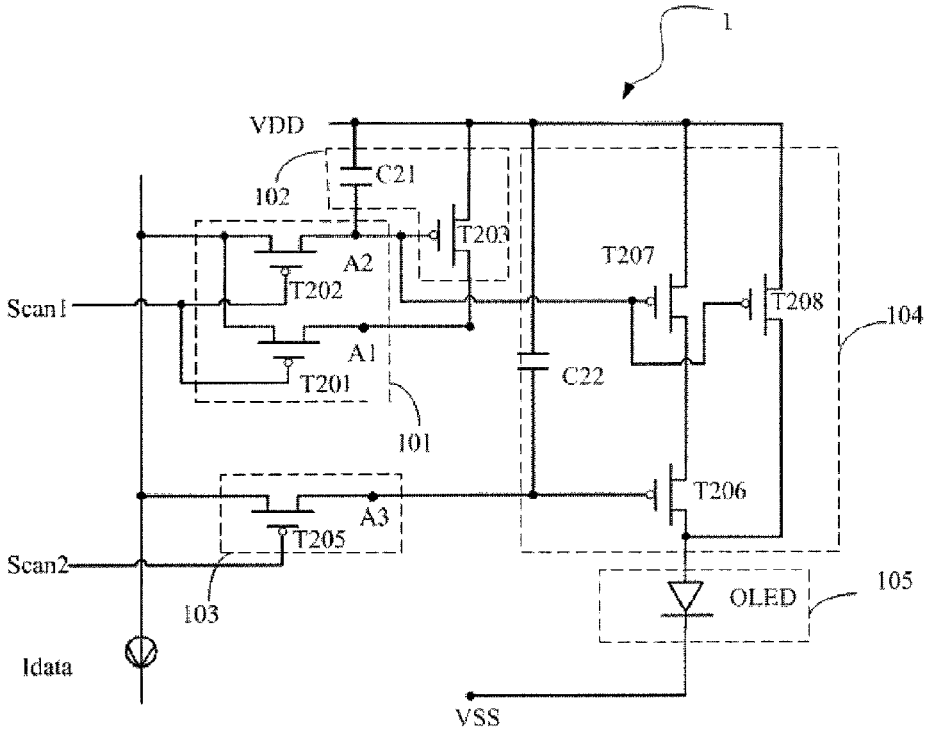
FIG. 9 is an exemplary view illustrating a structure of a pixel circuit according to a third embodiment of the present disclosure.
Figure 10:
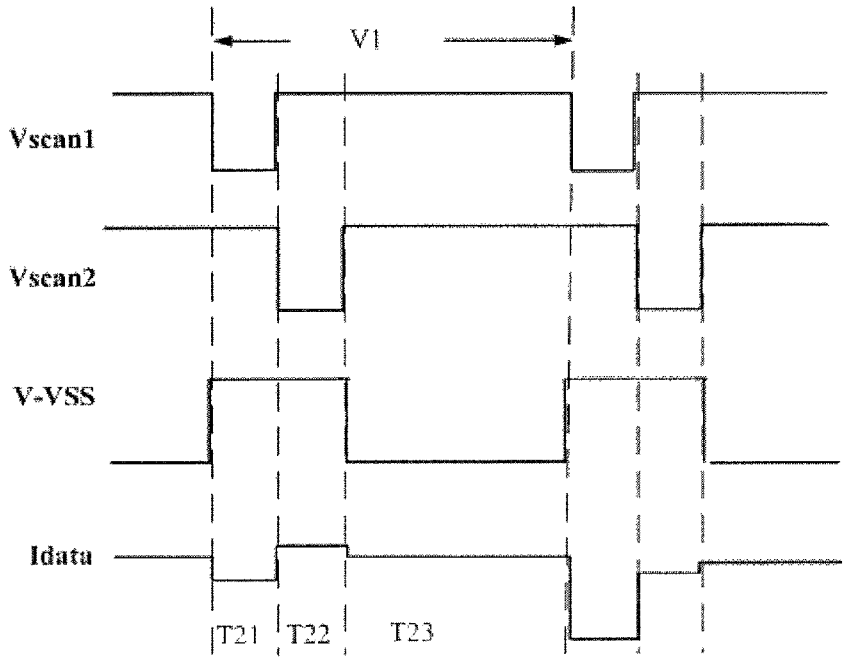
FIG. 10 is a timing diagram of the pixel circuit shown in FIG. 9.

Unlike the first Embodiment, all of the TFTs in the third Embodiment of the present disclosure are P-type TFTs which are all turned on at a low level and turned off at a high level, the first power supply is the positive power supply VDD, and the second power supply is the negative power supply VSS. A structure of the pixel circuit according to the third Embodiment is as illustrated in FIG. 9, its timing diagram is as illustrated in FIG. 10; therefore its driving method is as follows.

The driving method for the pixel circuit according to the third Embodiment of the present disclosure comprises:

During the first phase T21: the first scan signal Scan1 is at a low level, the second scan signal scan2 is at a high level, the second power supply terminal VSS outputs a high level, the data signal line Idata outputs an analog data signal, the load controlling module 101 transmits the analog data signal to the load module 102 and stores the analog data signal in the load module 102, and the light-emitting device 105 does not emit light.

In a specific implementation, this phase T21 is a pre-charging phase. The transistors T201-T203 are turned on and remaining transistors are turned off. This process completes a charging process for the capacitor C21. The light-emitting device OLED does not emit light at this time since the VSS is at a high level. During the phase T21, the data signal is an analog data signal corresponding to a small current for the low gray scale.

A second phase T22: the first scan signal Scan1 is at the high level, the second scan signal scan2 is at the low level, the second power supply terminal VSS outputs the high level, the data signal line Idata outputs a digital data signal and the digital data signal is transmitted to the third node A3, and the light-emitting device 105 does not emit light.

In a specific implementation, this phase T22 is a discharging phase. The transistors T201, T202 are turned off and the T203, T207, T208 are turned on. Since the analog data signal for the low gray scale is input during the phase T21, the Idata is a negative digital data signal in this phase, so that the C22 is discharged and the T206 is turned off. Assuming that the weight-length ratio between the transistors T207 and T208 is N:1, only a current from the T208 flows through the OLED in this case.

During a third phase T23: the first scan signal scant and the second scan signal scan2 are both at the high level, the second power supply terminal VSS outputs a low level, the data signal line Idata outputs a retaining signal, and the driving module 104 drives the light-emitting device 105 to emit light according to the signals from the second node A2 and the third node A3.

In a specific implementation, since the OLED is turned on in a case that the VSS outputs the low level, and a current Ioled is only equal to 1/(N+1) of the input current during the first phase. Thus the displaying in the low gray scale is realized by inputting a large current to expedite the charging process of the C21 during the first phase and making the driving current Ioled small.

Of course, in a specific implementation, if the input digital data signal Idata is a signal for the high gray scale during the phase T22, the C22 is charged and the T206 is turned on; next, during the phase T23, the OLED is turned on since the VSS is in the low level, so that the current flowing through the OLED comprises the currents from the T207 and T208 since the T206 is turned on. In this case, it can be seen that the Ioled is a large current corresponding to the high gray scale based on a proportion between T107, T108 and T203.

Fourth Embodiment

Figure 11:
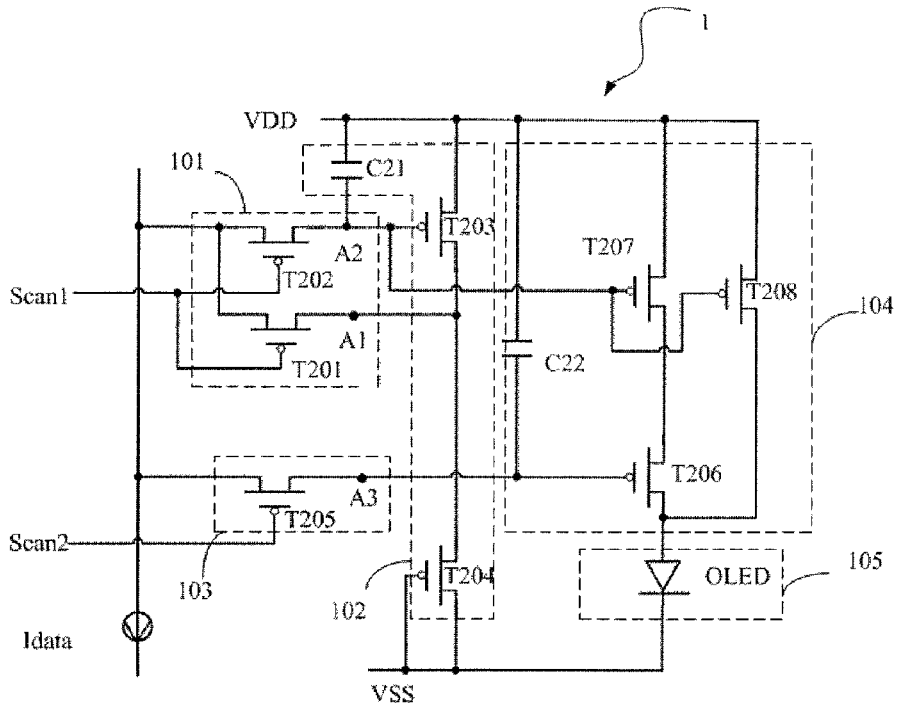
FIG. 11 is an exemplary view illustrating a structure of a pixel circuit according to a fourth embodiment of the present disclosure.

Based on the structure of the pixel circuit according to the third Embodiment, the load module may further comprise a fourth thin film transistor T204, as illustrated in FIG. 11, wherein a gate and a source of the fourth thin film transistor T204 are connected with the second power supply terminal VSS, and a drain thereof is connected with the first node A1.

Differences between a driving method according to the fourth Embodiment of the present disclosure and that according to the third Embodiment are in that:

during the third phase, the T204 is turned on in order to prevent the T203 from entering a deep linear region and avoid an interference with the voltage at the gate of the T203 due to a drop of the voltage at the drain of the T203, so that the T203 may be ensured to operate in a saturation region and provide the currents to the seventh thin film transistor T207 and the eighth thin film transistor T208.

Similarly, the incorporation of the fourth thin film transistor optimizes the structure of the pixel circuit.

Figure 12:
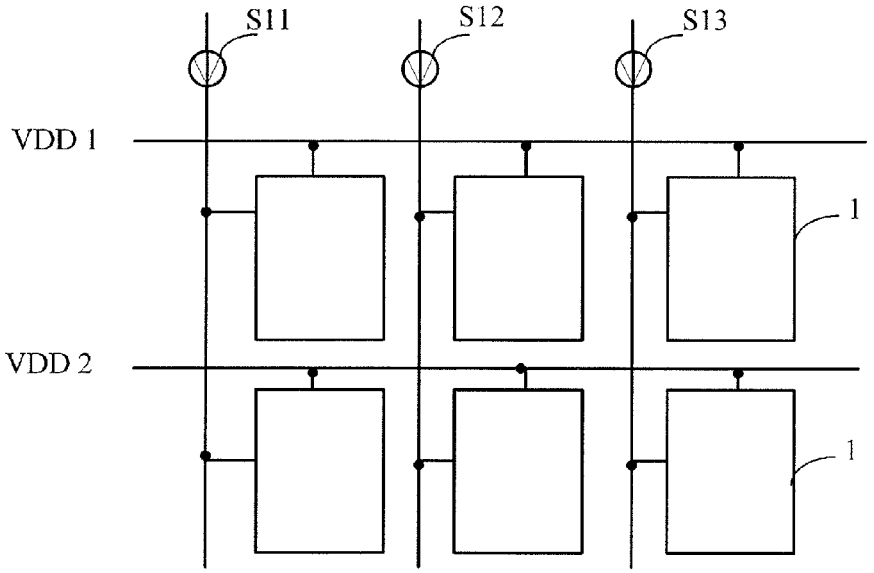
FIG. 12 is an exemplary view illustrating a pixel array structure according to an embodiment of the present disclosure.

As illustrated in FIG. 12, a pixel array structure according to the embodiments of the present disclosure comprises a plurality of pixel circuits 1 described above arranged in a matrix and a plurality of column drivers. In FIG. 12, the column drivers comprise a plurality of semi-digitized current sources S1 (S11, S12, S13, etc) for outputting both of the digital data signals and the analog data signals. The semi-digitized current source utilized in the embodiments of the present disclosure is only an optional scheme. Since the current-driving circuit structure is used, the analog data signal and the digital data signal both in the form of current are output successively from one current source in a specific implementation, that is: when the current value of the analog data signal is equal to or above a current value corresponding to the gray scale 32 during the first phase, the corresponding digital data signal is a positive current during the second phase; and when the current value of the analog data signal is below a current value corresponding to the gray scale 31 during the first phase, the corresponding digital data signal is a negative current during the second phase. Application of the semi-digitized current source is easy to be implemented and simplifies the structure. Of course, it may utilize other implementation, that is, the column drivers comprise current sources for outputting the analog data signals in the form of current and voltage sources (VDD1, VDD2, etc) for outputting the digital data signals in the form of voltage. That is: when the current value of the analog data signal is equal to or above a current value corresponding to the gray scale 32 during the first phase, the corresponding digital data signal is a positive voltage during the second phase; and when the current value of the analog data signal is below a current value corresponding to the gray scale 31 during the first phase, the corresponding digital data signal is a negative voltage during the second phase.

It should be noted that FIG. 12 only illustrates an exemplary view of a part of the pixel array structure but not the whole pixel array structure.

In conclusion, the embodiments of the present disclosure provide a pixel circuit, a driving method thereof and a pixel array structure. The pixel circuit according to the embodiments of the present disclosure comprises a load controlling module, a load module, a gray scale selection module, a driving module and a light-emitting device, wherein: the load controlling module is connected with a first scan signal line and a data signal line, and is used for outputting an analog data signal through a first node and a second node under the control of a first scan signal; the load module is connected with a first power supply terminal, the driving module, the first node and the second node, respectively, and is used for storing the analog data signal under an action of a first power supply and providing the driving module with the analog data signal, under the control of signals from the first node and the second node; the gray scale selection module is connected with a second scan signal line and the data signal line, and is used for transmitting a digital data signal to a third node located in the gray scale selection module under the control of a second scan signal; the driving module is used for driving the light-emitting device under the control of the signals from the second node and the third node; a first terminal of the light-emitting device is connected with a second power supply terminal, a second terminal thereof is connected with the driving module, and the light-emitting device emits light under actions of the second power supply and the driving module. The load module stores the analog signal; the driving module selectively drives the light-emitting device under the control of the signals from the second node and the third node and in turn. Thus it may expedite the charging by inputting a programmable large current when the picture with the low gray scale is required to be displayed. At a same time, in a displaying phase, the current for the low gray scale flows through the OLED by controlling the digital data signal, which may selectively inhibit the currents from corresponding TFTs, so that the displaying in the low gray scale is realized. When the picture with the high gray scale is required to be displayed, a current corresponding to the high gray scale is input and a short charging time is ensured. At a same time, in the displaying phase, the current for the high gray scale flows through the OLED by controlling the digital data signal, which may selectively allow the currents from the corresponding TFTs, so that the displaying in the high gray scale is realized. Therefore, the pixel circuit according to the embodiments of the present disclosure may reduce the charging time effectively and enhance the display effect.

Those skilled in the art should understand that the embodiments of the present disclosure may be provided as a method, a system or a computer program product. Therefore, the present disclosure may utilize forms of complete hardware embodiments, complete software embodiments, or embodiments combining hardware and software. Moreover, the present disclosure may utilize a form of computer program products implemented on one or more computer usable storage media (including but not limited to a magnetic disc storage, an optical storage, etc.) containing computer usable program codes.

The present disclosure is described by referring to flowchart and/or block diagram of the method, the device (system), and the computer program product according to the embodiments of the present disclosure. It should be understood that each process and/or block in the flowchart and/or the block diagram, and combinations of the processes and/or blocks in the flowchart and/or block diagram may be implemented by the computer program instructions. The computer program instructions may be provided to a general purpose computer, a dedicated purpose computer, an embedded processor or processors of other programmable data processing equipment to create a machine, so that the instructions executed by the computers or the processors of other programmable data processing equipment may generate the apparatus for realizing the function(s) specified in the one or more processes in the flowcharts and/or one or more blocks in the block diagrams.

The computer program instructions may also be stored in a computer readable memory capable of booting the computer or other programmable data processing equipment to operate in a specific manner, so that the instructions stored on the computer readable memory may generate a product comprising an instruction apparatus, the instruction apparatus may realize the function(s) specified in the one or more processes in the flowcharts and/or one or more blocks in the block diagrams.

The computer program instructions may also be loaded into the computer or other programmable data processing equipment, which make the computer or other programmable data processing equipment perform a series of operational steps to generate processing implementable by the computer, so that the instructions executed on the computer or other programmable data processing equipment may provide steps for realizing the function(s) specified in the one or more processes in the flowcharts and/or one or more blocks in the block diagrams.

Obviously, those skilled in the art may make various changes and variations on the embodiments of the present disclosure without departing from the spirit and scope of the present disclosure. Thus, the present disclosure intends to cover the changes and variations to the present disclosure provided that such changes and variations belong to the scope defined by the claims of the present disclosure and equivalence thereof.

What is claimed is:

1. A pixel circuit comprising a load controlling module, a load module, a gray scale selection module, a driving module and a light-emitting device, wherein:

the load controlling module is connected with a first scan signal line and a data signal line, and is used for outputting an analog data signal through a first node and a second node under a control of a first scan signal;

the load module is connected with a first power supply terminal, the driving module, the first node and the second node, respectively, and is used for storing the analog data signal under an action of a first power supply and providing the driving module with the analog data signal, under controls of signals from the first node and the second node;

the gray scale selection module is connected with a second scan signal line and the data signal line, and is used for transmitting a digital data signal to a third node located in the gray scale selection module under a control of a second scan signal;

the driving module is used for driving the light-emitting device under controls of the signals from the second node and the third node; and a first terminal of the light-emitting device is connected with a second power supply terminal, a second terminal thereof is connected with the driving module, and the light-emitting device emits light under actions of the second power supply and the driving module.

2. The circuit of claim 1, wherein the load controlling module comprises a first thin film transistor and a second thin film transistor, wherein, a gate of the first thin film transistor is connected with the first scan signal line, a source thereof is connected with the data signal line, and a drain thereof is connected with the first node located in the load controlling module; and a gate of the second thin film transistor is connected with the first scan signal line, a source thereof is connected with the data signal line, and a drain thereof is connected with the second node located in the load controlling module.

3. The circuit of claim 1, wherein the load module comprises a first storage capacitor and a third thin film transistor, wherein, the first storage capacitor is located between the second node and the first power supply terminal; and a gate of the third thin film transistor is connected with a first terminal of the first storage capacitor, a source thereof is connected with the first node, and a drain thereof is connected with the first power supply terminal.

4. The circuit of claim 3, wherein the load module further comprises a fourth thin film transistor, wherein a gate and a source of the fourth thin film transistor are connected with the second power supply terminal, and a drain thereof is connected with the first node.

5. The circuit of claim 1, wherein the gray scale selection module comprises a fifth thin film transistor, wherein a gate of the fifth thin film transistor is connected with the second scan signal line, a source thereof is connected with the data signal line, and a drain thereof is connected with the third node.

6. The circuit of claim 1, wherein the driving module comprises a second storage capacitor, a sixth thin film transistor, a seventh thin film transistor and an eighth thin film transistor, wherein, the second storage capacitor is located between the third node and the first power supply terminal;

a gate of the sixth thin film transistor is connected with the third node, a source thereof is connected with the second terminal of the light-emitting device, and a drain thereof is connected with a source of the seventh thin film transistor;

a gate of the seventh thin film transistor is connected with the second node, the source thereof is connected with the drain of the sixth thin film transistor, and a drain thereof is connected with the first power supply terminal; and a gate of the eighth thin film transistor is connected with the second node, a source thereof is connected with the second terminal of the light-emitting device, and a drain thereof is connected with the first power supply terminal.

7. The circuit of claim 6, wherein a ratio value between a weight-length ratio of the seventh thin film transistor and a weight-length ratio of the eighth thin film transistor is greater than 1.

8. The circuit of claim 1, wherein the light-emitting device is an Organic Light Emitting Diode OLED.

9. A pixel array structure comprising a plurality of column drivers and a plurality of pixel circuits of claim 1 arranged in a matrix, the column drivers are used for outputting data signals to the pixel circuits.

10. The pixel array structure of claim 9, wherein the column drivers comprise a plurality of semi-digitized current sources for outputting digital data signals and analog data signals.

11. The pixel array structure of claim 9, wherein the column drivers comprise current sources for outputting analog data signals and voltage sources for outputting digital data signals.

12. The pixel array structure of claim 9, wherein the load controlling module comprises a first thin film transistor and a second thin film transistor, wherein, a gate of the first thin film transistor is connected with the first scan signal line, a source thereof is connected with the data signal line, and a drain thereof is connected with the first node located in the load controlling module; and a gate of the second thin film transistor is connected with the first scan signal line, a source thereof is connected with the data signal line, and a drain thereof is connected with the second node located in the load controlling module.

13. The pixel array structure of claim 9, wherein the load module comprises a first storage capacitor and a third thin film transistor, wherein, the first storage capacitor is located between the second node and the first power supply terminal; and a gate of the third thin film transistor is connected with a first terminal of the first storage capacitor, a source thereof is connected with the first node, and a drain thereof is connected with the first power supply terminal.

14. The pixel array structure of claim 13, wherein the load module further comprises a fourth thin film transistor, wherein a gate and a source of the fourth thin film transistor are connected with the second power supply terminal, and a drain thereof is connected with the first node.

15. The pixel array structure of claim 9, wherein the gray scale selection module comprises a fifth thin film transistor, wherein a gate of the fifth thin film transistor is connected with the second scan signal line, a source thereof is connected with the data signal line, and a drain thereof is connected with the third node.

16. The pixel array structure of claim 9, wherein the driving module comprises a second storage capacitor, a sixth thin film transistor, a seventh thin film transistor and an eighth thin film transistor, wherein, the second storage capacitor is located between the third node and the first power supply terminal;

a gate of the sixth thin film transistor is connected with the third node, a source thereof is connected with the second terminal of the light-emitting device, and a drain thereof is connected with a source of the seventh thin film transistor;

a gate of the seventh this film transistor is connected with the second node, the source thereof is connected with the drain of the sixth thin film transistor, and a drain thereof is connected with the first power supply terminal; and a gate of the eighth thin film transistor is connected with the second node, a source thereof is connected with the second terminal of the light-emitting device, and a drain thereof is connected with the first power supply terminal.

17. The pixel array structure of claim 16, wherein a ratio value between a weight-length ratio of the seventh thin film transistor and a weight-length ratio of the eighth thin film transistor is greater than 1.

18. The pixel array structure of claim 9, wherein the light-emitting device is an Organic Light Emitting Diode OLED.

19. A driving method for the pixel circuit of claim 1, comprising:

during a first phase, outputting an analog data signal by the data signal line, transmitting the analog data signal to the load module and storing the analog data signal in the load module by the load controlling module, and no light being omitted from the light-emitting device;

during a second phase, outputting a digital data signal by the data signal line, transmitting the digital data signal to the third node, and no light being emitted from the light-emitting device; and during a third phase, outputting a retaining signal by the data signal line, and driving the light-emitting device to emit light by the driving module according to signals from the second node and the third node.

* * * * *